United States Patent [19]

Pallmeyer

[11] Patent Number: 4,814,784

[45] Date of Patent: Mar. 21, 1989

[54] INDIVIDUAL SELF-ERECTING ANTENNA

[75] Inventor: Henry L. Pallmeyer, Dix Hills, N.Y.

[73] Assignee: Grumman Aerospace Corporation, Bethpage, N.Y.

[21] Appl. No.: 790,667

[22] Filed: Oct. 23, 1985

[51] Int. Cl.[4] ..... H01Q 1/08

[52] U.S. Cl. ..... 343/882; 343/793; 343/DIG. 2

[58] Field of Search ..... 343/878–882, 343/805, 886, 892, 915, DIG. 2, 846, 793, 795, 757, 810; 244/173

[56] References Cited

U.S. PATENT DOCUMENTS

| | | | |
|---|---|---|---|
| 2,827,628 | 3/1958 | Swinehart et al. | 343/795 |
| 3,495,250 | 2/1970 | Farran et al. | 343/881 |
| 3,510,086 | 5/1970 | Arbeitlang et al. | 244/173 |
| 3,690,080 | 9/1972 | Dillard | 343/915 |
| 3,722,840 | 3/1973 | Andrews et al. | 244/173 |
| 3,817,481 | 6/1974 | Berks et al. | 244/173 |
| 3,971,023 | 7/1976 | Taggart | 343/840 |
| 4,030,103 | 6/1977 | Campbell | 343/915 |
| 4,115,784 | 9/1978 | Schwerdtfeger et al. | 343/915 |
| 4,133,501 | 1/1979 | Pentlicki | 244/173 |
| 4,164,339 | 8/1979 | McClenny | 244/163 |

*Primary Examiner*—William L. Sikes
*Assistant Examiner*—Michael C. Wimer
*Attorney, Agent, or Firm*—Pollock, Vande Sande & Priddy

[57] ABSTRACT

A self-erecting antenna includes a base for pivotally mounting two oppositely extending pi-shaped dipole antennas that are symmetrically positioned with respect to a medial ground plane attached to the base. Two sheets of flexible KAPTON material are each connected at opposite edges thereof, between the base and a respective dipole antenna, enabling collapsed folding of the antenna for storage. When the dipole antenna is free to move, the KAPTON sheets act like springs to erect the dipole antenna to a deployed condition.

9 Claims, 2 Drawing Sheets

DEPLOYED

DEPLOYED

STORED

DEPLOYED

INDIVIDUAL SELF-ERECTING ANTENNA

FIELD OF THE INVENTION

The present invention relates to radar antenna structures, and more particularly to an antenna which can be self erected in a space vehicle.

BACKGROUND OF THE INVENTION

In a number of space travel applications, antennas must be collapsed and stored during travel and, at an appropriate time, the antenna must be deployed to enable its use. This gives rise to the necessity of a low-cost, reliable self-erecting antenna which may be referred to as a "pop-up" antenna.

At the present time, space-based radar antennas consist of two antenna planes mounted on each side of a metal ground plane. The antenna is rolled on a drum in a stored position for transport to space. From that point, the erection of the antenna requires a deployment mechanism which is exposed to a harsh space environment which may render the mechanism inoperative when needed.

BRIEF DESCRIPTION OF THE PRESENT INVENTION

The present invention is directed to a self-erecting pop-up antenna which is extremely reliable and is relatively inexpensive to manufacture. The antenna includes a base for pivotally mounting two oppositely extending pi-shaped dipole antennas that are symmetrically positioned with respect to a medial ground plane attached to the base. Two sheets of flexible KAPTON material are each connected at opposite edges thereof, between the base and a respective dipole antenna, enabling collapsed folding of the antenna for storage. When the dipole antenna is free to move, the KAPTON sheets act like springs to erect the dipole antenna to a deployed condition.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE PRESENT INVENTION

Figure 1:
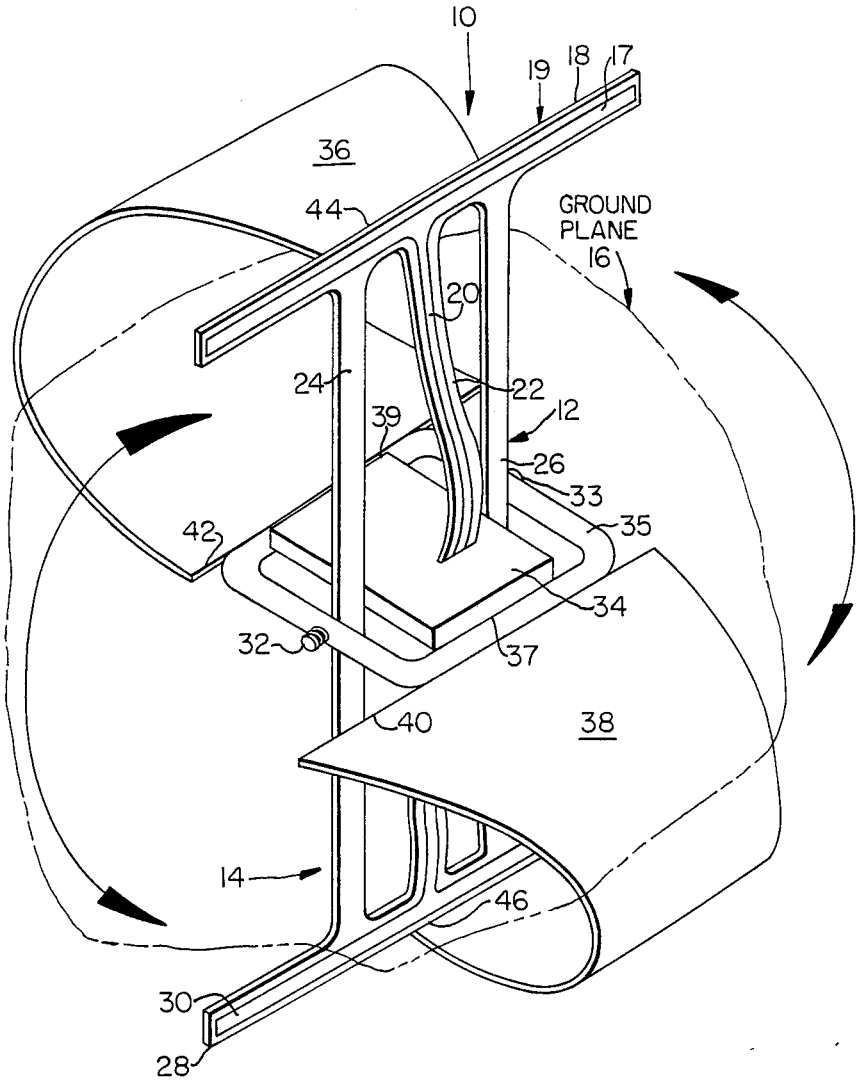
FIG. 1 is a perspective view of a deployed antenna structure in accordance with the present invention.

FIG. 1 illustrates in detail the structure of the present antenna when fully deployed. The structure is generally indicated by reference numeral 10 and is seen to include an upper dipole section 12 and lower dipole section 14, both of which are symmetrically positioned vertically above and below a flexible ground plane 16. As will be seen, this section includes a dipole wire 17 imbedded within an upper horizontal section 18 of a generally pi-shaped support 19 having integrally formed and perpendicularly extending legs 24 and 26. The support 19 is fabricated from KAPTON, a plastic having material stability as required in a space environment. A connecting conductor in the form of drop line 20 is connected to the dipole wire 17, the latter drop line being imbedded within a KAPTON web 22 extending perpendicularly downward from upper section 18 and between legs 24 and 26.

The lower dipole section 14 of the antenna structure is seen to include dipole wire 30 identical to wire 17 and is imbedded within lower horizontal section 28 which is integrally formed with legs 24 and 26 in a manner identical with the upper dipole section 12.

A generally square-shaped support ring 35 pivotally mounts legs 24 and 26 by respective pivot pins 32 and 33. A circuit module 34 is attached to inside surfaces of ring 35 at interfaces 37 and 39. A circuit module may include an antenna preamplifier circuit of conventional design.

Figure 2:
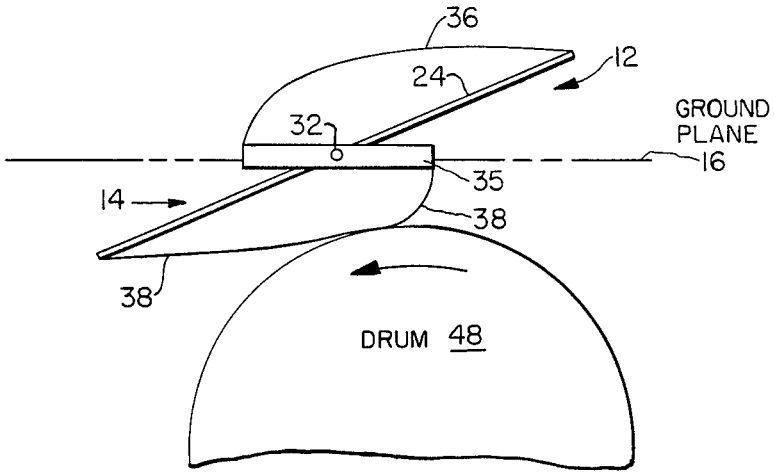
FIG. 2 is a diagrammatic end view of the self-erecting antenna when oriented in a stored position.

When the antenna structure of the present invention is stored during travel to space, the symmetrically positioned antenna dipole sections 12 and 14 are pivotally displaced so that they lie in a plane approaching the plane of ring 35. This is schematically depicted in FIG. 2. In many applications the ground plane 16 is common to a number of folded antennas rolled around a drum 48 in a manner resembling a window shade.

Figure 3:
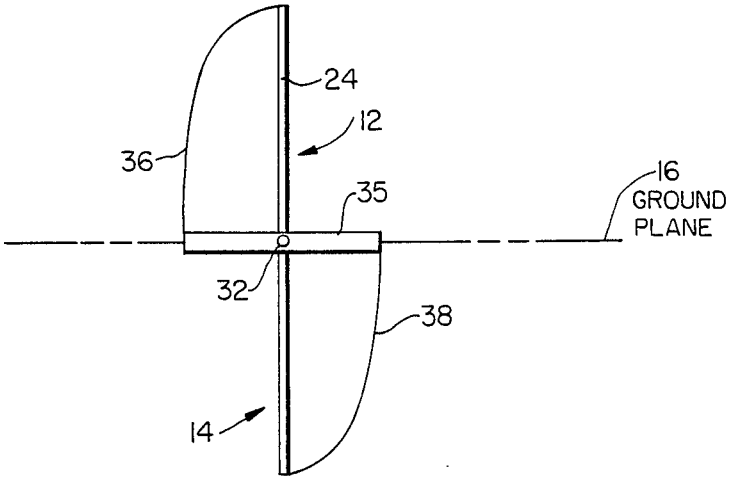
FIG. 3 is a diagrammatic end view indicating the symmetrical disposition of antenna dipoles relative to a ground plane.

In order to deploy the antenna sections upon arrival in space, it is necessary to displace the antenna sections to an erected position as schematically shown in FIG. 3. The movement of the antenna structure from the stored to deployed position will occur when the ground plane 16 is unrolled from the drum thereby freeing the antenna to self erect. To complete movement of the antenna structure to the deployed or erected position, two simply curved sheets of normally unconvoluted trapezoidally formed KAPTON are connected between ring 35 and the upper support section of each antenna dipole section 12, 14. This is shown in detail in FIG. 1. Thus, it will be appreciated that the KAPTON material must be flexible enough to be folded in a stored condition as shown in FIG. 2 yet capable of exhibiting spring qualities when ground plane 16 is unrolled from drum 48. The upper trapezoidal KAPTON sheet 36 has its upper trapezoidal edge connected to upper support section 18 along interface 44. Similarly, the lower trapezoidal edge is connected to ring 35 along interface 42. Similar connections between the lower KAPTON sheet 38 and the lower antenna dipole section 14 occur along interfaces 40 and 46.

The KAPTON sheets also act as protectors for the dipole antenna sections and are particularly useful to prevent entanglements between adjacent stored antennas spaced along a common ground plane 16 of drum 48 (FIG. 2). The ground plane 16 may be a slightly flexible metallic member capable of conforming to the outer surface of drum 48. It may be suitably attached to ring 35 (FIG. 1) at interfaces 42 and 40. When additional biasing of the antenna structure is needed to fully erect it, coil springs may be attached to pivot pins 32, 33.

Although the present invention has been described in terms of dipole antennas, it is to be understood that this is not a limitation of the invention. Further, the invention has utility in any application where self erection is desirable, a space application just being illustrative thereof. Also, KAPTON has been incorporated in a discussion of the invention but other suitable materials may be employed.

It should be understood that the invention is not limited to the exact details of construction shown and described herein, for obvious modifications will occur to persons skilled in the art.

I claim:

1. A self-erecting antenna having separate stored and erected states and comprising:

a central base;

a single unarticulated antenna support member pivotally mounted to the base and foldable with respect to it when the antenna is in a stored state;

at least one antenna element integrally formed with the antenna support member;

at least one sheet of spring-biased flexible material connected along a first edge to the base and along an opposite edge to the antenna support member the central sheet area therebetween being free of connection, the antenna support member and the antenna element connected thereto self erecting when externally applied forces normally biasing the support member and connected element in a folded position are removed.

2. The structure set forth in claim 1 wherein the antenna element is a dipole.

3. The structure set forth in claim 1 together with a flexible web integrally connected to the antenna support member for attaching an antenna drop line thereto, the latter being electrically connected to the antenna element.

4. The structure set forth in claim 3 together with a circuit module positioned within the base and connected to the drop line.

5. The structure set forth in claim 4 together with spring means connected to a pivotal shaft which in turn is connected to the antenna support member, the spring means assisting in erecting the antenna support and the antenna element connected thereto, when the forces are removed.

6. A self-erecting antenna comprising:

a central base;

an antenna support member pivotally mounted to the base and foldable with respect to it;

at least one antenna element connected to the antenna support member;

at least one sheet of flexible material connected between the base and the antenna support member for protecting the antenna from entanglements with adjacent antennas, and for erecting the antenna support member and the antennas element connected thereto, when externally applied forces normally biasing the support member and connected element in a folded position are removed;

wherein the antenna support member is a substantially rigid, generally pi-shaped member having a horizontal section for attaching the antenna element; and vertical spaced legs extending perpendicular to the horizontal section, the legs being pivotally mounted to the base.

7. A self-erecting antenna comprising:

an annular base;

a flexible ground plane member mounted to the base;

a pair of rigid parallel legs pivotally mounted to the base and extending on opposite sides of the ground plane;

a first antenna support member, attaching a dipole antenna conductor, and connected across adjacent first ends of the parallel legs;

a second antenna support member attaching a dipole antenna conductor and connected across adjacent second ends of the parallel legs;

first and second sheets of flexible material respectively connected between the base and the first and second support members for erecting the antenna support member and the antenna conductor attached thereto when forces biasing the sheets in the folded position are removed.

8. The structure set forth in claim 7 together with a flexible web connected to each antenna support member for carrying a respective antenna drop line electrically connected to a respective dipole antenna conductor.

9. The structure set forth in claim 8 together with a circuit module positioned within the base and connected to the drop line.

* * * * *

UNITED STATES PATENT AND TRADEMARK OFFICE

CERTIFICATE OF CORRECTION

PATENT NO. : 4,814,784

DATED : March 21, 1989

INVENTOR(S) : Henry L. Pallmeyer

It is certified that error appears in the above-identified patent and that said Letters Patent is hereby corrected as shown below:

Column 4, line 5, change "antennas" to --antenna--.

Signed and Sealed this

Second Day of January, 1990

*Attest:*

JEFFREY M. SAMUELS

*Attesting Officer*

*Acting Commissioner of Patents and Trademarks*